US012735778B2

(12) United States Patent
Sakakibara et al.

(10) Patent No.: US 12,735,778 B2
(45) Date of Patent: Sep. 15, 2026

(54) HOT-ROLLED STEEL SHEET

(71) Applicant: NIPPON STEEL CORPORATION, Tokyo (JP)

(72) Inventors: Mutsumi Sakakibara, Tokyo (JP); Tatsuo Yokoi, Tokyo (JP); Hiroshi Shuto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 543 days.

(21) Appl. No.: 18/039,682

(22) PCT Filed: Nov. 16, 2021

(86) PCT No.: PCT/JP2021/042116
§ 371 (c)(1),
(2) Date: May 31, 2023

(87) PCT Pub. No.: WO2022/153661
PCT Pub. Date: Jul. 21, 2022

(65) Prior Publication Data

US 2023/0416886 A1 Dec. 28, 2023

(30) Foreign Application Priority Data

Jan. 12, 2021 (JP) ..... 2021-002859

(51) Int. Cl.

| | |
|---|---|
| ***C22C 38/38*** | (2006.01) |
| ***C21D 1/18*** | (2006.01) |
| ***C21D 1/84*** | (2006.01) |
| ***C21D 6/00*** | (2006.01) |
| ***C21D 8/02*** | (2026.01) |
| ***C21D 8/021*** | (2026.01) |
| ***C21D 8/0221*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***C22C 38/28*** | (2006.01) |
| ***C22C 38/34*** | (2006.01) |

(52) U.S. Cl.
CPC ..... *C22C 38/38* (2013.01); *C21D 1/18* (2013.01); *C21D 1/84* (2013.01); *C21D 6/001* (2013.01); *C21D 6/002* (2013.01); *C21D 6/005* (2013.01); *C21D 6/007* (2013.01); *C21D 6/008* (2013.01); *C21D 8/02* (2013.01); *C21D 8/021* (2013.01); *C21D 8/0226* (2013.01); *C21D 9/46* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/28* (2013.01); *C22C 38/34* (2013.01); *C21D 2211/001* (2013.01); *C21D 2211/002* (2013.01); *C21D 2211/005* (2013.01); *C21D 2211/008* (2013.01); *C21D 2211/009* (2013.01)

(58) Field of Classification Search
None
See application file for complete search history.

(56) References Cited

U.S. PATENT DOCUMENTS

| | | | | |
|---|---|---|---|---|
| 2016/0177427 | A1 | 6/2016 | Takashima et al. | |
| 2020/0024683 | A1 * | 1/2020 | Yokoi ..... | C22C 38/06 |

FOREIGN PATENT DOCUMENTS

| | | | |
|---|---|---|---|
| JP | 5533729 | B2 | 6/2014 |
| JP | 2016-50335 | A | 4/2016 |
| JP | 2016-204690 | A | 12/2016 |
| KR | 10-2016-0047465 | A | 5/2016 |

* cited by examiner

*Primary Examiner* — Xiaowei Su
(74) *Attorney, Agent, or Firm* — Birch, Stewart, Kolasch & Birch, LLP

(57) ABSTRACT

This hot-rolled steel sheet has a desired chemical composition, a microstructure contains, in area %, ferrite: 10 to 30%, bainite: 40 to 85%, retained austenite: 5 to 30%, fresh martensite: 5% or less, and pearlite: 5% or less, the ferrite has an average particle size of 5.00 μm or less, a difference between an average nanoindentation hardness of the ferrite and an average nanoindentation hardness of the bainite is 1,000 MPa or less, and the tensile strength is 980 MPa or more.

2 Claims, No Drawings

HOT-ROLLED STEEL SHEET

TECHNICAL FIELD

The present invention relates to a hot-rolled steel sheet.

Priority is claimed on Japanese Patent Application No. 2021-002859, filed Jan. 12, 2021, the content of which is incorporated herein by reference.

BACKGROUND ART

In consideration of global environment protection, the weights of automobile bodies have been reduced in order to improve fuel efficiency of automobiles. In order to further reduce the weight of automobile bodies, it is necessary to increase the strength of steel sheets applied to automobile bodies. However, generally, if the strength of steel sheets increases, the moldability deteriorates.

As a method of improving moldability of steel sheets, there is a method of incorporating retained austenite into a microstructure of a steel sheet. However, when the microstructure of the steel sheet contains retained austenite, the ductility is improved, but hole expansibility and bendability may deteriorate. When bend molding, hole expansion processing and burring processing are performed, not only excellent ductility but also excellent hole expansibility and bendability are required.

Patent Document 1 discloses a hot-rolled steel sheet having excellent local deformability and excellent ductility with little orientation dependence of moldability and a method of producing the same. The inventors have found that the hot-rolled steel sheet described in Patent Document 1 needs to have higher strength, ductility, hole expansibility and bendability.

CITATION LIST

Patent Document

Patent Document 1

Japanese Patent No. 5533729

SUMMARY OF THE INVENTION

Problems to be Solved by the Invention

An object of the present invention is to provide a hot-rolled steel sheet having excellent strength, ductility, hole expansibility and bendability.

Means for Solving the Problem

In view of the above circumstances, the inventors conducted extensive studies regarding the relationship between a chemical composition and microstructure of a hot-rolled steel sheet and mechanical properties, and as a result, the following findings (a) to (d) were obtained, and the present invention was completed.

(a) In order to obtain excellent strength, it is necessary to include a desired amount of bainite in the microstructure and to increase the strength of ferrite by precipitation of Ti carbides in the ferrite through including a desired amount of Ti.

(b) In order to obtain excellent ductility, it is necessary to include a desired amount of ferrite and retained austenite in the microstructure. However, when ferrite and retained austenite are included, the hole expansibility and bendability of the hot-rolled steel sheet deteriorate.

(c) When the average particle size of ferrite is controlled to be within a desired range, it is possible to further improve the strength and it is possible to improve the hole expansibility and bendability.

(d) When the difference in hardness between ferrite and bainite is reduced, it is possible to further improve the hole expansibility and bendability.

The gist of the present invention achieved based on the above findings is as follows.

(1) A hot-rolled steel sheet according to one aspect of the present invention having a chemical composition containing, in mass %, C: 0.100 to 0.350%,
Si: 0.01 to 3.00%,
Mn: 1.00 to 4.00%,
sol. Al: 0.001 to 2.000%,
Si+sol. Al: 1.00% or more,
Ti: 0.010 to 0.380%,
P: 0.100% or less,
S: 0.0300% or less,
N: 0.1000% or less,
O: 0.0100% or less,
Nb: 0 to 0.100%.
V: 0 to 0.500%,
Cu: 0 to 2.00%,
Cr: 0 to 2.00%,
Mo: 0 to 1.00%,
Ni: 0 to 2.00%,
B: 0 to 0.0100%.
Ca: 0 to 0.0200%,
Mg: 0 to 0.0200%,
REM: 0 to 0.1000%,
Bi: 0 to 0.020%,
one, two or more of Zr, Co. Zn and W: 0 to 1.00% in total, and
Sn: 0 to 0.050%,
in which Tief represented by the following Formula (a) is 0.010 to 0.300%, and
the remainder consists of Fe and impurities, and
a microstructure comprising, in area %,
ferrite: 10 to 30%,
bainite: 40 to 85%,
retained austenite: 5 to 30%,
fresh martensite: 5% or less, and
pearlite: 5% or less,
wherein the ferrite has an average particle size of 5.00 μm or less,
wherein a difference between an average nanoindentation hardness of the ferrite and an average nanoindentation hardness of the bainite is 1,000 MPa or less, and
wherein the tensile strength is 980 MPa or more:

$$Tief=Ti-48/14\times N-48/32\times S \quad (a)$$

where each element symbol in Formula (a) indicates their content (mass %).

(2) The hot-rolled steel sheet according to (1),
wherein the chemical composition contains, in mass %, one, two or more selected from the group consisting of
Nb: 0.005 to 0.100%,
V: 0.005 to 0.500%,
Cu: 0.01 to 2.00%,
Cr: 0.01 to 2.00%,
Mo: 0.01 to 1.00%,
Ni: 0.02 to 2.00%,
B: 0.0001 to 0.0100%, Ca: 0.0005 to 0.0200%,
Mg: 0.0005 to 0.0200%,
REM: 0.0005 to 0.1000%, and
Bi: 0.0005 to 0.020%.

Effects of the Invention

According to the above aspect of the present invention, it is possible to provide a hot-rolled steel sheet having excellent strength, ductility, hole expansibility and bendability.

Embodiment(s) for Implementing the Invention

A chemical composition and a microstructure of a hot-rolled steel sheet according to the present embodiment will be described in detail. However, the present invention is not limited to only the configuration disclosed in the present embodiment and can be variously modified without departing from the gist of the present invention.

Hereinafter, a numerical value limiting a range indicated by "to" includes both the lower limit value and the upper limit value. Numerical values indicated by "less than" or "more than" are not included in these numerical value range. In the following description, % related to the chemical composition of the steel sheet is mass % unless otherwise specified.

Chemical Composition

A chemical composition of a hot-rolled steel sheet according to the present embodiment contains, in mass %, C: 0.100 to 0.350%, Si: 0.01 to 3.00%, Mn: 1.00 to 4.00%, sol. Al: 0.001 to 2.000%, Si+sol. Al: 1.00% or more, Ti: 0.010 to 0.380%, P: 0.100% or less, S: 0.0300% or less, N: 0.1000% or less, O: 0.0100% or less, and the remainder: Fe and impurities.

Hereinafter, respective elements will be described in detail.

C: 0.100 to 0.350%

C is an element required to obtain desired strength. If the C content is less than 0.100%, it is difficult to obtain desired strength. Therefore, the C content is 0.100% or more. The C content is preferably 0.120% or more or 0.150% or more.

On the other hand, if the C content is more than 0.350%, the transformation rate becomes slow, an MA (a mixed phase of martensite and retained austenite) is likely to be generated, and it is difficult to obtain excellent hole expansibility and bendability. Therefore, the C content is 0.350% or less. The C content is preferably 0.330% or less, 0.310% or less, 0.300% or less or 0.280% or less.

Si: 0.01 to 3.00%

Si has a function of delaying precipitation of cementite. This function can increase the amount of untransformed austenite remaining, that is, the area proportion of retained austenite. In addition, the strength can be increased by maintaining a large amount of C dissolved in a hard phase and preventing cementite from coarsening. In addition, Si itself also has an effect of increasing the strength of the hot-rolled steel sheet according to solid solution strengthening. In addition, Si has a function of minimizing flaws in steel (minimizing the occurrence of defects such as blowholes in steel) by deacidification. If the Si content is less than 0.01%, it is not possible to obtain the effect of the above function. Therefore, the Si content is 0.01% or more. The Si content is preferably 0.50% or more, 1.00% or more, 1.20% or more, or 1.50% or more.

On the other hand, if the Si content is more than 3.00%, this is not preferable because precipitation of cementite is significantly delayed and the amount of retained austenite becomes excessive. In addition, the surface properties and chemical convertibility of the hot-rolled steel sheet, as well as, ductility and weldability, significantly deteriorate, and the $A_3$ transformation point significantly rises. Accordingly, it is difficult to stably perform hot rolling. Therefore, the Si content is 3.00% or less. The Si content is preferably 2.70% or less or 2.50% or less.

Mn: 1.00 to 4.00%

Mn has a function of inhibiting ferrite transformation and increasing the strength of the hot-rolled steel sheet. If the Mn content is less than 1.00%, it is not possible to obtain desired strength. Therefore, the Mn content is 1.00% or more. The Mn content is preferably 1.50% or more, 1.80% or more, 2.00% or more or 2.40% or more.

On the other hand, if the Mn content is more than 4.00%, the ductility, hole expansibility and bendability of the hot-rolled steel sheet deteriorate. Therefore, the Mn content is 4.00% or less. The Mn content is preferably 3.70% or less, 3.50% or less, 3.30% or less or 3.00% or less.

sol. Al: 0.001 to 2.000%

Like Si, sol. Al has a function of deacidifying steel and minimizing flaws in the steel sheet, inhibiting precipitation of cementite from austenite, and promoting generation of retained austenite. If the sol. Al content is less than 0.001%, it is not possible to obtain the effect of the above function. Therefore, the sol. Al content is 0.001% or more. The sol. Al content is preferably 0.010% or more.

On the other hand, if the sol. Al content is more than 2.000%, the above effect is maximized and it is not economically preferable. In addition, the $A_3$ transformation point significantly rises, and it is difficult to stably perform hot rolling. Therefore, the sol. Al content is 2.000% or less. The sol. Al content is preferably 1.500% or less or 1.300% or less.

Here, in the present embodiment, sol. Al is acid-soluble Al, and indicates solid solution Al present in steel in a solid solution state.

Si+Sol. Al: 1.00% or More

Si and sol. Al both have a function of delaying precipitation of cementite, and this function can increase the amount of untransformed austenite remaining, that is, the area proportion of retained austenite. If a total amounts of Si and sol. Al is less than 1.00%, it is not possible to obtain the effect of the above function. Therefore, the total amounts of Si and sol. Al is 1.00% or more, and preferably 1.20% or more or 1.50% or more.

The total amounts of Si and sol. Al may be 5.00% or less, 3.00% or less or 2.60% or less.

Here, Si of "Si+sol. Al" indicates the content (mass %) of Si, and sol. Al indicates the content (mass %) of sol. Al.

Ti: 0.010 to 0.380%

Ti precipitates as carbides or nitrides (mainly Ti carbides) in steel, refines the microstructure according to a pinning effect, and additionally increases the strength of ferrite by precipitation strengthening. As a result, it is possible to reduce a difference in hardness between ferrite and bainite. If the Ti content is less than 0.010%, it is not possible to obtain the effect. Therefore, the Ti content is 0.010% or more, and preferably 0.050% or more, 0.070% or more, 0.090% or more, or 0.120% or more.

On the other hand, even if the Ti content is more than 0.380%, the above effect is maximized. Therefore, the Ti content is 0.380% or less, and preferably 0.350% or less, 0.320% or less, or 0.300% or less.

P: 0.100% or Less

P is an element that is generally contained in steel as impurities, and has a function of increasing the strength of the hot-rolled steel sheet according to solid solution strengthening. Therefore, P may be actively contained. However, P is an element that easily segregates, and if the P content is more than 0.100%, the ductility is significantly lowered due to grain boundary segregation. Therefore, the P content is 0.100% or less. The P content is preferably 0.030% or less.

Although it is not particularly necessary to specify the lower limit of the P content, 0.001% is preferable in consideration of refining cost.

S: 0.0300% or Less

S is an element that is contained in steel as impurities, and forms sulfide-based inclusions in steel and lowers the ductility of the hot-rolled steel sheet. If the S content is more than 0.0300%, the ductility of the hot-rolled steel sheet is significantly lowered. Therefore, the S content is 0.0300% or less. The S content is preferably 0.0050% or less.

Although it is not particularly necessary to specify the lower limit of the S content, 0.0001% is preferable in consideration of refining cost.

N: 0.1000% or Less

N is an element that is contained in steel as impurities, and has a function of lowering the ductility of the hot-rolled steel sheet. If the N content is more than 0.1000%, the ductility of the hot-rolled steel sheet is significantly lowered. Therefore, the N content is 0.1000% or less. The N content is preferably 0.0800% or less, or 0.0700% or less. Although it is not particularly necessary to specify the lower limit of the N content, in order to promote precipitation of carbonitride, the N content is preferably 0.0010% or more and more preferably 0.0020% or more.

O: 0.0100% or Less

When a large amount of O is contained in steel, a coarse oxide that acts as a starting point for fracture is formed, which causes brittle fracture or hydrogen-induced cracking. Therefore, the O content is 0.0100% or less. The O content is preferably 0.0080% or less or 0.0050% or less.

In order to disperse a large number of fine oxides during deacidification of molten steel, the O content may be 0.0005% or more or 0.0010% or more.

Tief: 0.010 to 0.300%

Tief represented by the following Formula (a) is an index related to generation of Ti carbides. Ti nitrides and Ti sulfides are generated at a higher temperature than Ti carbides. Therefore, if the amounts of N and S in steel is large, Ti carbides cannot be sufficiently generated. If the amounts of Tief is less than 0.010%, since the amount of precipitated Ti carbides is small, it is not possible to obtain an effect of improving the strength of ferrite with Ti carbides. As a result, it is not possible to reduce a difference in hardness between ferrite and bainite. Therefore, Tief is 0.010% or more, and preferably 0.050% or more or 0.100% or more.

On the other hand, even if the amounts of Tief is more than 0.300%, the above effect is maximized so that it is not economically preferable. Therefore, Tief is 0.300% or less, and preferably 0.270% or less or 0.250% or less.

$$Tief=Ti-48/14\times N-48/32\times S \quad (a)$$

Here, each element symbol in Formula (a) indicates the content (mass %).

The remainder of the chemical composition of the hot-rolled steel sheet according to the present embodiment is composed of Fe and impurities. In the present embodiment, impurities are elements that are mixed in from ores or scrap as raw materials or a production environment or the like, or elements that are intentionally added in very small amounts, and have a meaning that they are allowable as long as they do not adversely affect the hot-rolled steel sheet according to the present embodiment.

The hot-rolled steel sheet according to the present embodiment may contain the following elements as optional elements in addition to the above elements. The lower limit of the content when the above optional elements are not contained is 0%. Hereinafter, respective optional elements will be described in detail.

Nb: 0.005 to 0.100% and V: 0.005 to 0.500%

Nb and V both precipitate as carbides or nitrides in steel, and have a function of refining the microstructure according to a pinning effect, and thus one, two or more of these elements may be contained. In order to more reliably obtain the effect of the above function, it is preferable to set the Nb content to 0.005% or more, and the V content to 0.005% or more.

However, even if these elements are excessively contained, the effect of the above function is maximized and it is not economically preferable. Therefore, the Nb content is 0.100% or less, and the V content is 0.500% or less.

Cu: 0.01 to 2.00%, Cr: 0.01 to 2.00%, Mo: 0.01 to 1.00%, Ni: 0.02 to 2.00% and B: 0.0001 to 0.0100%

Cu, Cr, Mo, Ni and B all have a function of increasing the hardenability of the hot-rolled steel sheet. In addition, Cr and Ni have a function of stabilizing retained austenite, and Cu and Mo have a function of precipitating carbides in steel and increasing the strength of the hot-rolled steel sheet. In addition, when Cu is contained, Ni has a function of effectively reducing grain boundary cracks of a slab caused by Cu. Therefore, one, two or more of these elements may be contained.

Cu has a function of increasing the hardenability of the steel sheet and a function of precipitating carbides in steel at a low temperature and increasing the strength of the hot-rolled steel sheet. In order to more reliably obtain the effect of the above function, the Cu content is preferably 0.01% or more.

However, if the Cu content is more than 2.00%, grain boundary cracks may occur in the slab. Therefore, the Cu content is 2.00% or less.

As described above, Cr has a function of increasing the hardenability of the steel sheet and a function of stabilizing retained austenite. In order to more reliably obtain the effect of the above function, the Cr content is preferably 0.01% or more.

However, if the Cr content is more than 2.00%, the chemical convertibility of the hot-rolled steel sheet is significantly lowered. Therefore, the Cr content is 2.00% or less.

As described above, Mo has a function of increasing the hardenability of the steel sheet and a function of precipitating carbides in steel and increasing the strength. In order to more reliably obtain the effect of the above function, the Mo content is preferably 0.01% or more.

However, even if the Mo content is more than 1.00%, the effect of the above function is maximized, and it is not economically preferable. Therefore, the Mo content is 1.00% or less.

As described above, Ni has a function of increasing the hardenability of the steel sheet. In addition, when Cu is contained, Ni has a function of effectively reducing grain boundary cracks of a slab caused by Cu. In order to more reliably obtain the effect of the above function, the Ni content is preferably 0.02% or more.

Since Ni is an expensive element, containing a large amount thereof is not economically preferable. Therefore, the Ni content is 2.00% or less.

As described above, B has a function of increasing the hardenability of the steel sheet. In order to more reliably obtain the effect of the function, the B content is preferably 0.0001% or more.

However, if the B content is more than 0.0100%, since the ductility of the hot-rolled steel sheet is significantly lowered, the B content is 0.0100% or less.

Ca: 0.0005 to 0.0200%, Mg: 0.0005 to 0.0200%, REM: 0.0005 to 0.1000% and Bi: 0.0005 to 0.020%

Ca, Mg and REM all have a function of controlling the shape of the inclusion to a preferable shape and increasing the moldability of the hot-rolled steel sheet. In addition, Bi has a function of refining the solidified structure and increasing the moldability of the hot-rolled steel sheet. Therefore, one, two or more of these elements may be contained. In order to more reliably obtain the effect of the above function, it is preferable to contain 0.0005% or more of any one or more of Ca, Mg, REM and Bi. However, if the Ca content or the Mg content is more than 0.0200% or the REM content is more than 0.1000%, inclusions are excessively generated in steel and thus the ductility of the hot-rolled steel sheet may be lowered. In addition, even if the Bi content is more than 0.020%, the effect of the above function is maximized, and it is not economically preferable. Therefore, the Ca content and the Mg content are 0.0200% or less, the REM content is 0.1000% or less, and the Bi content is 0.020% or less. The Bi content is preferably 0.010% or less.

Here, REM refers to a total of 17 elements constituting of Sc, Y and lanthanides, and the REM content refers to a total amounts of these elements. In the case of lanthanides, they are industrially added in the form of misch metals.

One, two or more of Zr, Co, Zn and W: 0 to 1.00% in total and Sn: 0 to 0.050%

Regarding Zr, Co, Zn and W, the inventors confirmed that, even if a total amount of 1.00% or less of these elements is contained, the effects of the hot-rolled steel sheet according to the present embodiment are not impaired. Therefore, a total amount of 1.00% or less of one, two or more of Zr, Co, Zn and W may be contained.

In addition, the inventors confirmed that, even if a small amount of Sn is contained, the effects of the hot-rolled steel sheet according to the present embodiment are not impaired, but flaws during hot rolling may occur so that the Sn content is 0.050% or less.

The chemical composition of the above hot-rolled steel sheet may be measured by a general analysis method. For example, inductively coupled plasma-atomic emission spectrometry (ICP-AES) may be used for measurement. Here, sol. Al may be measured through ICP-AES using a filtrate after thermal decomposition of a sample with an acid. C and S may be measured using a combustion-infrared absorption method, N may be measured using an inert gas fusion-thermal conductivity method, and O may be measured using an inert gas fusion-non-dispersive infrared absorption method.

Microstructure of Hot-Rolled Steel Sheet

Next, a microstructure of a hot-rolled steel sheet according to the present embodiment will be described.

In the hot-rolled steel sheet according to the present embodiment, the microstructure contains, in area %, ferrite: 10 to 30%, bainite: 40 to 85%, retained austenite: 5 to 30%, fresh martensite: 5% or less, and pearlite: 5% or less, and the ferrite has an average particle size of 5.00 μm or less, and a difference between the average nanoindentation hardness of the ferrite and the average nanoindentation hardness of the bainite is 1,000 MPa or less.

Here, in the present embodiment, the microstructure is specified in the sheet thickness cross section parallel to the rolling direction, at a depth position of ¼ of the sheet thickness from the surface (an area from the surface to a depth of ⅛ of the sheet thickness to from the surface to a depth of ⅜ of the sheet thickness). The reason for this is that the microstructure at that position is a typical microstructure of the hot-rolled steel sheet.

Ferrite: 10 to 30%

Ferrite is a structure that improves the ductility of the hot-rolled steel sheet, although it has poor strength. If the area proportion of ferrite is less than 10%, it is not possible to obtain desired ductility. Therefore, the area proportion of ferrite is 10% or more, and preferably 12% or more or 15% or more.

On the other hand, if the area proportion of ferrite is more than 30%, it is not possible to obtain desired strength. Therefore, the area proportion of ferrite is 30% or less, and preferably 27% or less or 25% or less.

Bainite: 40 to 85%

Bainite is a structure that improves the strength and ductility of the hot-rolled steel sheet. If the area proportion of bainite is less than 40%, it is not possible to obtain desired strength and ductility. Therefore, the area proportion of bainite is 40% or more, and preferably 50% or more, 55% or more, or 60% or more.

On the other hand, if the area proportion of bainite is more than 85%, it is not possible to obtain desired ductility. Therefore, the area proportion of bainite is 85% or less, and preferably 82% or less or 80% or less.

Retained austenite: 5 to 30%

Retained austenite is a structure that improves the ductility of the hot-rolled steel sheet. If the area proportion of retained austenite is less than 5%, it is not possible to obtain desired ductility. Therefore, the area proportion of retained austenite is 5% or more, and preferably 7% or more, 10% or more, 12% or more, 13% or more, 14% or more or 15% or more.

On the other hand, if the area proportion of retained austenite is more than 30%, it is not possible to obtain desired strength. Therefore, the area proportion of retained austenite is 30% or less, and preferably 25% or less or 23% or less.

Fresh Martensite: 5% or Less

Since fresh martensite is a hard structure, it contributes to improving the strength of the hot-rolled steel sheet. However, fresh martensite is also a poorly ductile structure. If the area proportion of fresh martensite is more than 5%, it is not possible to obtain desired ductility. Therefore, the area proportion of fresh martensite is 5% or less, and preferably 4% or less, 3% or less, or 2% or less. The area proportion of fresh martensite may be 0%.

Pearlite: 5% or Less

If the area proportion of pearlite is too large, it is not possible to obtain a desired amount of retained austenite. Therefore, the area proportion of pearlite is 5% or less, and preferably 4% or less, 3% or less, or 2% or less. The area proportion of pearlite may be 0%.

Among the above structures, the area proportion of structures other than retained austenite is measured by the following method.

A test piece is taken from the hot-rolled steel sheet so that the microstructure of the sheet thickness cross section parallel to the rolling direction at a depth of ¼ of the sheet thickness from the surface (an area from the surface to a depth of ⅛ of the sheet thickness to from the surface to a depth of ⅜ of the sheet thickness) can be observed. Next, the sheet thickness cross section is polished, the polished surface is then subjected to nital corrosion, and a 30 μm×30 μm area is subjected to structure observation using an optical microscope and a scanning electron microscope (SEM). Observation areas are at least three areas. Image analysis is performed on the structure image obtained by the structure observation, and the area proportion of each of ferrite, pearlite and bainite is obtained. Then, repeller corrosion is performed on the same observation position, structure observation is then performed using an optical microscope and a scanning electron microscope, image analysis is performed on the obtained structure image, and thereby the area proportion of fresh martensite is obtained.

In the above structure observation, each structure is identified by the following method.

Fresh martensite is a structure having a high dislocation density and substructures such as blocks and packets within the grains so that it is possible to distinguish it from other microstructures according to electron channeling contrast images using a scanning electron microscope.

A structure that is an aggregate of lath-shaped crystal grains, and is not fresh martensite among structures that do not contain Fe-based carbides with a major axis of 20 nm or more inside the structure or a structure which contains Fe-based carbides with a major axis of 20 nm or more inside the structure and in which the Fe-based carbides have a single variant, that is, Fe-based carbides extending in the same direction, is regarded as bainite. Here, Fe-based carbides elongated in the same direction are Fe-based carbides with a difference of 5 or less in the elongation direction.

A structure that is a lump of crystal grains and does not contain substructures such as laths inside the structure is regarded as ferrite.

A structure in which plate-like ferrite and Fe-based carbides overlap in layers is regarded as pearlite.

The area proportion of retained austenite is measured by the following method.

In the present embodiment, the area proportion of retained austenite is measured by X-ray diffraction. First, in the sheet thickness cross section parallel to the rolling direction of the hot-rolled steel sheet, at a depth of ¼ of the sheet thickness from the surface (an area from the surface to a depth of ⅛ of the sheet thickness to from the surface to a depth of ⅜ of the sheet thickness), using Co-Kα rays, an integrated intensity of a total of 6 peaks of α(110), α(200), α(211), γ(111), γ(200), and γ(220) is obtained, and an intensity average method is used for calculation. Thereby, the area proportion of retained austenite is obtained.

Average Particle Size of Ferrite: 5.00 μm or Less

The size of ferrite greatly influences the strength, hole expansibility and bendability of the hot-rolled steel sheet. If the average particle size of ferrite is more than 5.00 μm, it is not possible to improve the strength, hole expansibility and/or bendability of the hot-rolled steel sheet. Therefore, the average particle size of ferrite is 5.00 μm or less, and preferably 4.00 μm or less, 3.50 μm or less, or 3.00 μm or less.

Although the lower limit is not particularly specified, the average particle size of ferrite may be 0.50 μm or more or 1.00 μm or more.

The average particle size of ferrite is measured by the following method.

The average crystal particle size of ferrite is obtained by performing the following measurement on the same area as the area observed using the above optical microscope and scanning electron microscope. After the sheet thickness cross section is polished using #600 to #1500 silicon carbide paper, diamond powder with a grain size of 1 to 6 μm is used in a diluted solution such as an alcohol of a liquid dispersed in pure water to achieve a mirror finish. Next, strain introduced into the surface layer of the sample is removed by electropolishing. At an arbitrary position on the cross section of the sample in the longitudinal direction, an area with a length of 50 μm and from the surface to a depth of ⅛ of the sheet thickness to from the surface to a depth of ⅜ of the sheet thickness is measured at measurement intervals of 0.1 μm by an electron backscattering diffraction method, and thereby crystal orientation information is obtained. For the measurement, an EBSD device composed of a thermal field emission scanning electron microscope (JSM-7001F commercially available from JEOL), and an EBSD detector (DVC5 type detector commercially available from TSL) is used. In this case, the degree of vacuum in the EBSD device is $9.6\times10^{-5}$ Pa or less, the acceleration voltage is 15 kV, the emission current level is 13, and the electron beam emission level is 62.

The obtained crystal orientation data group is analyzed with analysis software (TSL OIM Analysis), interfaces with an orientation difference of 150 or more are defined as crystal grain boundaries, and the crystal particle size is calculated as a circle equivalent diameter from the area of a region surrounded by the crystal grain boundaries. Of these, regarding crystal grains identified as ferrite under the above optical microscope and scanning electron microscope (SEM), the average crystal particle size is calculated as the median diameter ($D_{50}$) from the crystal particle size histogram.

Difference Between Average Nanoindentation Hardness of Ferrite and Average Nanoindentation Hardness of Bainite: 1,000 MPa or Less If the difference between the average nanoindentation hardness of ferrite and the average nanoindentation hardness of bainite is more than 1,000 MPa, it is not possible to improve the hole expansibility and/or bendability. Therefore, the difference between the average nanoindentation hardness of ferrite and the average nanoindentation hardness of bainite is 1,000 MPa or less, and preferably 950 MPa or less, 900 MPa or less, or 850 MPa or less.

Although the lower limit is not particularly specified, the difference between the average nanoindentation hardness of ferrite and the average nanoindentation hardness of bainite may be 500 MPa or more, 600 MPa or more or 700 MPa or more.

The average nanoindentation hardness of ferrite and the average nanoindentation hardness of bainite are measured by the following method.

In a field of view in which the area proportion of the above microstructure is measured, in the area determined as ferrite, the hardness is measured by the nanoindentation method. The martens hardness of ferrite is measured at at least 20 points or more, the average value is calculated, and the average nanoindentation hardness of ferrite is obtained. The same operation is performed on bainite, and the average nanoindentation hardness of bainite is obtained.

Here, TriboScope/TriboIndenter (commercially available from Hysitron) is used for measurement, and the measurement load may be 1 mN.

Mechanical Properties

The hot-rolled steel sheet according to the present embodiment has a tensile (maximum) strength of 980 MPa or more. If the tensile strength is set to 980 MPa or more, it is possible to contribute to weight reduction of the vehicle body. More preferably, the tensile strength is 1,180 MPa or more. It is not particularly necessary to limit the upper limit, but may be 1.470 MPa.

The product (TS×uEl) of the tensile strength and uniform elongation, which is an index of ductility, is 8,260 MPa·% or more.

The hole expansion rate, which is an index of hole expansibility, may be 45% or more.

The maximum bending angle, which is an index of bendability, may be 60° or more.

The tensile strength TS and the uniform elongation uEl are measured using JIS Z2241: 2011 No. 5 test piece according to JIS Z2241: 2011. The position of the tensile test piece that is taken out may be a part of ¼ from the end in the sheet width direction, and the direction perpendicular to the rolling direction may be a longitudinal direction.

The hole expansion rate λ is measured according to JIS Z 2256: 2020. The position of the hole expansion test piece that is taken out may be a part of ¼ from the end of the hot-rolled steel sheet in the sheet width direction.

The maximum bending angle α is evaluated based on the VDA standard (VDA238-100) defined by the German Association of the Automotive Industry. The displacement at the maximum load obtained in the bending test is converted into an angle based on the VDA standard, and the maximum bending angle α is obtained.

Sheet Thickness

The sheet thickness of the hot-rolled steel sheet according to the present embodiment is not particularly limited, but may be 0.5 to 8.0 mm. When the sheet thickness of the hot-rolled steel sheet is set to 0.5 mm or more, it is possible to easily secure the rolling completion temperature, it is possible to reduce the rolling load, and it is possible to easily perform hot rolling. Therefore, the sheet thickness of the hot-rolled steel sheet according to the present embodiment may be 0.5 mm or more, and is preferably 1.2 mm or more or 1.4 mm or more. In addition, when the sheet thickness is set to 8.0 mm or less, the microstructure can be easily refined, and it is possible to easily secure the above microstructure. Therefore, the sheet thickness may be 8.0 mm or less, and is preferably 6.0 mm or less.

Plating Layer

The hot-rolled steel sheet according to the present embodiment having the chemical composition and microstructure described above may have a plating layer on the surface in order to improve corrosion resistance, and may be used as a surface-treated steel sheet. The plating layer may be an electroplating layer or a melt plating layer. Examples of electroplating layers include electrogalvanizing and electro Zn—Ni alloy plating. Examples of melt plating layers include melt galvanizing, alloyed melt galvanizing, melt aluminum plating, melt Zn—Al alloy plating, melt Zn—Al—Mg alloy plating, and melt Zn—Al—Mg—Si alloy plating. The amount of plating adhered is not particularly limited, and may be the same as in the related art. In addition, after plating, an appropriate chemical conversion treatment (for example, applying a silicate-based chromium-free chemical conversion treatment solution and drying) is performed, and it is possible to further improve corrosion resistance.

Production Conditions

In a preferable method of producing a hot-rolled steel sheet according to the present embodiment, the following processes (1) to (7) are performed in order. Here, the temperature of the slab and the temperature of the steel sheet in the present embodiment refer to the surface temperature of the slab and the surface temperature of the steel sheet. In the present embodiment, the temperature of the hot-rolled steel sheet is measured with a contact or non-contact thermometer if the location is the outermost end in the sheet width direction. If the location is somewhere other than the outermost end of the hot-rolled steel sheet in the sheet width direction, the temperature is measured by a thermocouple or calculated by heat transfer analysis.

(1) A slab is heated in a temperature range of T0° C. or higher represented by the following Formula (1), held in the temperature range for 6,000 seconds or more, and rough rolling is then performed.

(2) After the rough rolling is completed, finish rolling is performed within 150 seconds.

(3) A cumulative rolling reduction rate in a temperature range of T1 (° C.) to T1+30° C. is more than 30%, a cumulative rolling reduction rate during finish rolling is 90% or more, and a final rolling reduction rate during finish rolling is 15% or more. Here, T1 (° C.) is represented by the following Formula (2).

(4) Cooling starts within 1.0 second after the finish rolling is completed, and cooling is performed to a temperature range of 600 to 700° C. at an average cooling rate of 20° C./s or more.

(5) After air cooling is performed for 1.0 to 3.0 seconds in a temperature range of 600 to 700° C., cooling is performed at an average cooling rate of 40° C./s or more.

(6) Coiling is performed in a temperature range of T2 (° C.) to 500° C.

(7) The average cooling rate to a temperature range of 150° C. or lower is set to 15 to 40° C./h.

$$T0(^\circ C.)=7000/\{2.75-\log(Ti\times C)\}-273 \quad (1)$$

$$T1(^\circ C.)=850+10\times(C+N)\times Mn+350\times Nb+250\times Ti+40\times B+10\times Cr+100\times Mo+100\times V \quad (2)$$

$$T2(^\circ C.)=591-474\times C-33\times Mn-17\times Ni-17\times Cr-21\times Mo \quad (3)$$

Here, an element symbol in Formulae (1) to (3) indicates the content (mass %) of each element, and when the element is not contained, 0 is assigned.

Slab Temperature and Holding Time During Hot Rolling

For a slab to be hot-rolled, a slab obtained by continuous casting or a slab obtained by casting and blooming can be used. As necessary, one obtained by performing hot processing or cold processing on a slab can be used. In order to sufficiently dissolve Ti carbides, it is preferable to heat a slab to be hot-rolled in a temperature range of T0 (° C.) or higher, and hold it in this temperature range for 6.000 seconds or more. When Ti carbides cannot be sufficiently dissolved, a sufficient amount of Ti carbides cannot be precipitated in ferrite as a result, and it may not be possible to reduce the difference in hardness between ferrite and bainite.

For hot rolling, it is preferable to use a reverse mill or tandem mill for multi-pass rolling. In particular, in consideration of industrial productivity, it is more preferable to perform hot rolling using a tandem mill for at least the last several stages.

Rough Rolling

After holding in a temperature range of TO (° C.) or higher for 6,000 seconds or more, rough rolling is performed. Rough rolling conditions are not particularly limited, and rough rolling may be performed by a general method.

Finish Rolling

After the rough rolling is completed, it is preferable to perform finish rolling within 150 seconds. That is, it is preferable to perform the first pass rolling of finish rolling within 150 seconds after the final pass rolling of rough rolling is completed. After the rough rolling is completed, finish rolling is performed within 150 seconds, and in secondary cooling to be described below, it is possible to precipitate a sufficient amount of Ti carbides in ferrite without excessive precipitation of Ti carbides in retained austenite. As a result, it is possible to reduce a difference in hardness between ferrite and bainite.

In addition, in finish rolling, preferably, in a temperature range of T1 (° C.) to T1+30° C., the cumulative rolling reduction rate is more than 30%, the cumulative rolling reduction rate during finish rolling is 90% or more, and the final rolling reduction rate during finish rolling is 15% or more. When finish rolling is performed under such conditions, a desired amount of ferrite can be obtained. Here, the finish rolling completion temperature is preferably 830° C. or higher.

Here, the cumulative rolling reduction rate in a temperature range of Ti (° C.) to T1+30° C. can be expressed as $(t_0-t_1)/t_0\times100(\%)$ when the inlet sheet thickness before the first pass in rolling in this temperature range is $t_0$, and the outlet sheet thickness after the final pass in rolling in this temperature range is $t_1$.

The cumulative rolling reduction rate during finish rolling can be expressed as $(t_i-t_f)/t_i\times100(\%)$ when the inlet sheet thickness before the first pass of finish rolling is $t_i$ and the outlet sheet thickness after the final pass of finish rolling is $t_f$.

The final rolling reduction rate during finish rolling can be expressed as $(t_2-t_3)/t_2\times100(\%)$ when the inlet sheet thickness before the final pass of finish rolling is $t_2$, and the outlet sheet thickness after final pass of finish rolling is $t_3$.

Primary Cooling after Finish Rolling Completion

After the finish rolling is completed, it is preferable to start cooling within 1.0 second and perform cooling in a temperature range of 600 to 700° C. at an average cooling rate of 20° C./s or more. In other words, it is preferable to start cooling at an average cooling rate of 20° C./s or more within 1.0 second after the finish rolling is completed, and perform this cooling to a temperature range of 600 to 700° C. When primary cooling is performed within 1.0 second after the finish rolling is completed, it is possible to preferably control the average particle size of ferrite. In addition, when primary cooling is performed to a temperature range of 600 to 700° C., it is possible to reduce a difference in hardness between ferrite and bainite.

Here, the average cooling rate referred to in the present embodiment is a value obtained by dividing a difference in temperature between the start of cooling and the end of cooling by a time elapsed from the start of cooling to the end of cooling.

Intermediate Air Cooling and Secondary Cooling

After cooling is performed to a temperature range of 600 to 700° C., air cooling is performed in this temperature range for 1.0 to 3.0 seconds, and cooling is then performed at an average cooling rate of 40° C./s or more. Air cooling here is cooling at an average cooling rate of 10° C./s or less. Unless heat is input from the outside by a heating device or the like, even with a sheet thickness of about half an inch, the cooling rate in air cooling is about 3° C./s. When secondary cooling is performed under such conditions, it is possible to obtain a desired amount of ferrite and retained austenite and it is possible to precipitate a sufficient amount of Ti carbides in the ferrite. As a result, it is possible to reduce a difference in hardness between ferrite and bainite.

Cooling with an average cooling rate of 40° C./s or more is preferably performed to a temperature range of T2 (° C.) to 500° C. so that coiling is performed at a coiling temperature to be described below. In other words, the cooling stop temperature for cooling with an average cooling rate of 40° C./s or more is preferably in a temperature range of T2 (° C.) to 500° C.

Coiling

The coiling temperature is preferably in a temperature range of T2 (° C.) to 500° C. When coiling is performed in this temperature range, it is possible to minimize excessive precipitation of fresh martensite, and it is possible to obtain a desired amount of bainite. If the coiling temperature is higher than 500° C., generation of cementite according to bainite transformation is promoted, and a desired amount of retained austenite may not be obtained. If the coiling temperature is less than T2 (° C.), tempered martensite may be generated.

Tertiary Cooling after Coiling

After coiling, the average cooling rate to a temperature range of 150° C. or lower is preferably 15 to 40° C./h. When tertiary cooling is performed under such conditions, carbon can be concentrated in retained austenite and the retained austenite can be stabilized. As a result, a desired amount of retained austenite can be obtained. The average cooling rate is more preferably 20° C./h or more. In addition, the average cooling rate is more preferably less than 30° C./h.

In addition, the average cooling rate after coiling may be controlled using a heat insulating cover, an edge mask, mist cooling or the like.

EXAMPLES

Next, effects of one aspect of the present invention will be described in more detail with reference to examples, but conditions in the examples are one condition example used for confirming the feasibility and effects of the present invention, and the present invention is not limited to this one condition example. In the present invention, various conditions can be used without departing from the gist of the present invention and as long as the object of the present invention can be achieved.

Steels having chemical compositions shown in Tables 1 and 2 were melted, and slabs with a thickness of 240 to 300 mm were produced by continuous casting. Using the obtained slabs, hot-rolled steel sheets were obtained under production conditions shown in Tables 3 and 4.

Here, before hot rolling, the sample was heated to the slab heating temperature shown in Table 3 and held for 6,000 seconds or more. In Table 4, in Production No. 10, after primary cooling, air cooling was performed in a temperature range of 530° C. or lower for an air cooling time shown in Table 4, and in Production No. 11, after primary cooling, air cooling was performed in a temperature range of higher than 700° C. and 723° C. or lower for an air cooling time shown in Table 4. In addition, in all examples, tertiary cooling was performed to a temperature range of 150° C. or lower.

For the obtained hot-rolled steel sheets, the area proportion of each structure, the average particle size of ferrite, the difference between the average nanoindentation hardness of ferrite and the average nanoindentation hardness of bainite, the tensile strength TS, the uniform elongation uEl, the hole expansion rate γ and the maximum bending angle α were measured by the above methods. Here, a total elongation El (elongation at break according to JIS Z 2241: 2011) was obtained by a tensile test in which the tensile strength TS and the uniform elongation uEl were measured.

The obtained measurement results are shown in Table 5. Here, in Production No. 15, a 40 area % tempered martensite (a structure that could not be determined as any structure by the above structure observation method) was generated in addition to the structure shown in Table 5.

Evaluation Criteria

If the tensile strength TS was 980 MPa or more, it was determined satisfactory because the sample had excellent strength. On the other hand, if the tensile strength TS was less than 980 MPa, it was determined unsatisfactory because the sample did not have excellent strength.

If the product (TS×uEl) of the tensile strength TS and the uniform elongation uEl was 8,260 MPa·% or more, it was determined satisfactory because the sample had excellent ductility. On the other hand, if the TS×uEl was less than 8,260 MPa·%, it was determined unsatisfactory because the sample did not have excellent ductility.

If the hole expansion rate γ was 45% or more, it was determined satisfactory because the sample had excellent hole expansibility. On the other hand, if the hole expansion rate γ was less than 45%, it was determined unsatisfactory because the sample did not have excellent hole expansibility.

If the maximum bending angle was 60' or more, it was determined satisfactory because the sample had excellent bendability. On the other hand, if the maximum bending angle was less than 60°, it was determined unsatisfactory because the sample did not have excellent bendability.

TABLE 1

| | Mass %, remainder being Fe and impurities | | | | | | | | |
|---|---|---|---|---|---|---|---|---|---|
| Steel No. | C | Si | Mn | sol. Al | Si + sol. Al | Ti | P | S | N |
| A | 0.152 | 0.90 | 2.70 | 0.620 | 1.52 | 0.120 | 0.021 | 0.0019 | 0.0034 |
| B | 0.210 | 2.25 | 2.61 | 0.033 | 2.28 | 0.061 | 0.020 | 0.0011 | 0.0026 |
| C | 0.345 | 1.26 | 1.85 | 0.750 | 2.01 | 0.051 | 0.023 | 0.0020 | 0.0023 |
| D | 0.165 | 0.85 | 2.07 | 0.260 | 1.11 | 0.095 | 0.019 | 0.0027 | 0.0031 |
| E | 0.256 | 1.24 | 2.49 | 1.310 | 2.55 | 0.090 | 0.022 | 0.0011 | 0.0016 |
| F | 0.264 | 1.56 | 1.42 | 0.650 | 2.21 | 0.065 | 0.021 | 0.0017 | 0.0038 |
| G | 0.124 | 1.85 | 3.67 | 0.023 | 1.87 | 0.113 | 0.021 | 0.0033 | 0.0028 |
| H | 0.194 | 2.16 | 2.45 | 0.033 | 2.19 | 0.075 | 0.023 | 0.0025 | 0.0019 |
| I | 0.185 | 2.20 | 2.08 | 0.019 | 2.22 | 0.121 | 0.021 | 0.0027 | 0.0022 |
| J | 0.167 | 2.43 | 3.21 | 0.018 | 2.45 | 0.086 | 0.018 | 0.0030 | 0.0028 |
| K | 0.168 | 1.95 | 2.04 | 0.038 | 1.99 | 0.072 | 0.025 | 0.0025 | 0.0031 |
| L | 0.185 | 1.61 | 2.91 | 0.040 | 1.65 | 0.096 | 0.023 | 0.0031 | 0.0028 |
| M | 0.240 | 2.23 | 1.92 | 0.015 | 2.25 | 0.054 | 0.016 | 0.0035 | 0.0038 |
| N | 0.154 | 2.05 | 2.66 | 0.023 | 2.07 | 0.062 | 0.017 | 0.0024 | 0.0015 |
| O | 0.096 | 2.13 | 2.45 | 0.022 | 2.15 | 0.058 | 0.025 | 0.0029 | 0.0036 |
| P | 0.381 | 2.37 | 2.90 | 0.035 | 2.41 | 0.134 | 0.015 | 0.0018 | 0.0019 |
| Q | 0.154 | 0.51 | 2.63 | 0.450 | 0.96 | 0.065 | 0.015 | 0.0036 | 0.0015 |
| R | 0.251 | 1.77 | 0.86 | 0.032 | 1.80 | 0.074 | 0.024 | 0.0011 | 0.0039 |
| S | 0.175 | 2.01 | 4.24 | 0.029 | 2.04 | 0.053 | 0.024 | 0.0029 | 0.0026 |
| T | 0.216 | 1.79 | 2.45 | 0.029 | 1.82 | 0.009 | 0.024 | 0.0029 | 0.0026 |
| U | 0.270 | 1.24 | 2.46 | 0.380 | 1.62 | 0.052 | 0.024 | 0.0056 | 0.0120 |
| V | 0.101 | 2.06 | 1.97 | 0.040 | 2.10 | 0.016 | 0.010 | 0.0030 | 0.0030 |
| W | 0.110 | 0.65 | 2.82 | 1.240 | 1.89 | 0.376 | 0.012 | 0.0049 | 0.0204 |
| X | 0.121 | 1.65 | 3.50 | 0.460 | 2.11 | 0.312 | 0.023 | 0.0018 | 0.0036 |

| | Mass %, remainder being Fe and impurities | | | | | | | | |
|---|---|---|---|---|---|---|---|---|---|
| Steel No. | O | Nb | V | Cu | Cr | Mo | Ni | B | Note |
| A | 0.0038 | | | | | | | | Steel of the present invention |
| B | 0.0031 | | | | | | | | Steel of the present invention |
| C | 0.0033 | | | | | | | | Steel of the present invention |
| D | 0.0027 | | | | | | | | Steel of the present invention |
| E | 0.0016 | | | | | | | | Steel of the present invention |
| F | 0.0025 | | | | | | | | Steel of the present invention |
| G | 0.0046 | | | | | | | | Steel of the present invention |
| H | 0.0022 | 0.042 | | | | | | | Steel of the present invention |

TABLE 1-continued

| | | | | | | | | |
|---|---|---|---|---|---|---|---|---|
| I | 0.0051 | 0.034 | | | | | | Steel of the present invention |
| J | 0.0042 | | 0.04 | | | | | Steel of the present invention |
| K | 0.0054 | | | 0.42 | | | | Steel of the present invention |
| L | 0.0030 | | | | 0.14 | | | Steel of the present invention |
| M | 0.0047 | | | | | 0.19 | | Steel of the present invention |
| N | 0.0032 | | | | | | 0.0025 | Steel of the present invention |
| O | 0.0037 | | | | | | | Comparative steel |
| P | 0.0043 | | | | | | | Comparative steel |
| Q | 0.0015 | | | | | | | Comparative steel |
| R | 0.0034 | | | | | | | Comparative steel |
| S | 0.0039 | | | | | | | Comparative steel |
| T | 0.0039 | | | | | | | Comparative steel |
| U | 0.0058 | | | | | | | Comparative steel |
| V | 0.0031 | | | | | | | Comparative steel |
| W | 0.0010 | | | | | | | Steel of the present invention |
| X | 0.0025 | | | | | | | Steel of the present invention |

The underline indicates that it is outside the scope of the present invention

TABLE 2

| Steel | Mass %, remainder being Fe and impurities | | | | | | | | | | | | | |
|---|---|---|---|---|---|---|---|---|---|---|---|---|---|---|
| No. | Ca | Mg | REM | Bi | Zr | Co | Zn | W | Sn | Tief | T0 | T1 | T2 | Note |
| A | 0.0021 | 0.0014 | | | | | | | | 0.105 | 1286 | 884 | 430 | Steel of the present invention |
| B | | | | | | | | | | 0.050 | 1235 | 871 | 405 | Steel of the present invention |
| C | | | 0.0017 | | | | | | | 0.040 | 1281 | 869 | 366 | Steel of the present invention |
| D | | | | 0.003 | | | | | | 0.080 | 1264 | 877 | 444 | Steel of the present invention |
| E | | | | | | | | | | 0.083 | 1322 | 879 | 387 | Steel of the present invention |
| F | | | | | | | | | | 0.049 | 1277 | 870 | 419 | Steel of the present invention |
| G | | | | | | | | | | 0.098 | 1248 | 883 | 411 | Steel of the present invention |
| H | | | | | 0.08 | | | | | 0.065 | 1253 | 888 | 418 | Steel of the present invention |
| I | | | | | | | | 0.03 | | 0.109 | 1318 | 888 | 435 | Steel of the present invention |

TABLE 2-continued

| Steel | Mass %, remainder being Fe and impurities | | | | | | | | | | | | | |
|---|---|---|---|---|---|---|---|---|---|---|---|---|---|---|
| No. | Ca | Mg | REM | Bi | Zr | Co | Zn | W | Sn | Tief | T0 | T1 | T2 | Note |
| J | | | | | | 0.05 | | | | 0.072 | 1251 | 877 | 406 | Steel of the present invention |
| K | | | | | | | | | | 0.058 | 1227 | 876 | 437 | Steel of the present invention |
| L | | | | | | | | | 0.018 | 0.082 | 1282 | 893 | 404 | Steel of the present invention |
| M | | | | | | | | | | 0.036 | 1236 | 868 | 411 | Steel of the present invention |
| N | | | | | | | 0.14 | | | 0.053 | 1194 | 870 | 430 | Steel of the present invention |
| O | | | | | | | | | | 0.041 | 1126 | 867 | 465 | Comparative steel |
| P | | | | | | | | | | 0.125 | 1459 | 895 | 315 | Comparative steel |
| Q | | | | | | | | | | 0.054 | 1201 | 870 | 431 | Comparative steel |
| R | | | | | | | | | | 0.059 | 1289 | 871 | 444 | Comparative steel |
| S | | | | | | | | | | 0.040 | 1191 | 871 | 368 | Comparative steel |
| T | | | | | | | | | | −0.004 | 1009 | 858 | 408 | Comparative steel |
| U | | | | | | | | | | 0.002 | 1248 | 870 | 382 | Comparative steel |
| V | | | | | | | | | | 0.001 | 990 | 856 | 478 | Comparative steel |
| W | | | | | | | | | | 0.299 | 1421 | 948 | 446 | Steel of the present invention |
| X | | | | | | | | | | 0.297 | 1404 | 932 | 418 | Steel of the present invention |

The underline indicates that it is outside the scope of the present invention

TABLE 3

| Production No. | Steel No. | Slab heating temperature ° C. | Time from completion of rough rolling until finish rolling s | Cumulative rolling reduction rate in a temperature range of T1 to T1 + 30° C. % | Cumulative rolling reduction rate during finish rolling % | Final rolling reduction rate during finish rolling % | Time from completion of finish rolling until start of cooling s |
|---|---|---|---|---|---|---|---|
| 1 | A | 1300 | 66 | 32 | 94 | 19 | 0.9 |
| 2 | B | 1250 | 60 | 32 | 93 | 17 | 0.7 |
| 3 | B | 1200 | 70 | 31 | 93 | 15 | 0.8 |
| 4 | B | 1250 | 165 | 32 | 93 | 15 | 0.8 |
| 5 | B | 1250 | 109 | 20 | 93 | 20 | 0.8 |
| 6 | B | 1250 | 95 | 32 | 85 | 20 | 0.9 |
| 7 | B | 1250 | 65 | 32 | 93 | 12 | 0.7 |
| 8 | B | 1250 | 65 | 54 | 93 | 16 | 1.3 |
| 9 | B | 1250 | 66 | 54 | 93 | 18 | 0.9 |
| 10 | B | 1250 | 43 | 32 | 94 | 18 | 0.7 |
| 11 | B | 1250 | 76 | 32 | 94 | 20 | 0.9 |
| 12 | B | 1250 | 59 | 32 | 93 | 18 | 0.5 |
| 13 | B | 1250 | 99 | 44 | 93 | 15 | 0.7 |
| 14 | B | 1250 | 36 | 32 | 93 | 15 | 0.8 |
| 15 | B | 1250 | 60 | 38 | 93 | 15 | 0.8 |
| 16 | B | 1250 | 75 | 32 | 93 | 15 | 0.9 |
| 17 | B | 1250 | 110 | 32 | 93 | 15 | 0.8 |
| 18 | C | 1290 | 95 | 41 | 90 | 15 | 0.7 |
| 19 | D | 1290 | 68 | 39 | 90 | 18 | 0.7 |
| 20 | E | 1350 | 77 | 41 | 91 | 16 | 0.8 |
| 21 | F | 1280 | 41 | 51 | 91 | 16 | 0.8 |
| 22 | G | 1260 | 63 | 51 | 90 | 20 | 1.0 |
| 23 | H | 1260 | 85 | 36 | 94 | 19 | 0.9 |
| 24 | I | 1320 | 95 | 51 | 94 | 15 | 0.8 |
| 25 | J | 1260 | 80 | 36 | 90 | 20 | 0.7 |

TABLE 3-continued

| Production No. | Steel No. | Slab heating temperature ° C. | Time from completion of rough rolling until finish rolling s | Cumulative rolling reduction rate in a temperature range of T1 to T1 + 30° C. % | Cumulative rolling reduction rate during finish rolling % | Final rolling reduction rate during finish rolling % | Time from completion of finish rolling until start of cooling s |
|---|---|---|---|---|---|---|---|
| 26 | K | 1250 | 89 | 40 | 92 | 19 | 1.0 |
| 27 | L | 1290 | 57 | 38 | 91 | 15 | 0.7 |
| 28 | M | 1250 | 81 | 39 | 90 | 15 | 0.6 |
| 29 | N | 1230 | 55 | 42 | 90 | 17 | 1.0 |
| 30 | O | 1230 | 47 | 41 | 93 | 16 | 0.9 |
| 31 | P | 1300 | 67 | 54 | 90 | 17 | 0.8 |
| 32 | Q | 1250 | 66 | 54 | 90 | 20 | 0.9 |
| 33 | R | 1300 | 76 | 39 | 90 | 20 | 0.8 |
| 34 | S | 1230 | 101 | 54 | 93 | 20 | 0.8 |
| 35 | T | 1230 | 64 | 40 | 92 | 20 | 0.7 |
| 36 | U | 1250 | 40 | 43 | 90 | 15 | 1.0 |
| 37 | V | 1200 | 122 | 30 | 94 | 28 | 0.4 |
| 38 | W | 1420 | 120 | 75 | 94 | 15 | 0.5 |
| 39 | X | 1410 | 94 | 72 | 93 | 16 | 0.7 |
| 40 | B | 1250 | 135 | 32 | 94 | 20 | 0.5 |

The underline indicates that conditions are not preferable

TABLE 4

| Production No. | Steel No. | Average cooling rate of primary cooling ° C./s | Primary cooling stop temperature ° C. | Air cooling time in a temperature range of 600 to 700° C. s | Average cooling rate of secondary cooling ° C./s | Coiling temperature ° C. | Average cooling rate of tertiary cooling ° C./h | Note |
|---|---|---|---|---|---|---|---|---|
| 1 | A | 41 | 681 | 2.9 | 44 | 436 | 27 | Example of the present invention |
| 2 | B | 49 | 627 | 2.8 | 44 | 423 | 20 | Example of the present invention |
| 3 | B | 51 | 618 | 2.7 | 53 | 408 | 27 | Comparative Example |
| 4 | B | 49 | 624 | 1.1 | 51 | 410 | 27 | Comparative Example |
| 5 | B | 50 | 623 | 2.8 | 45 | 412 | 27 | Comparative Example |
| 6 | B | 46 | 641 | 2.9 | 40 | 423 | 27 | Comparative Example |
| 7 | B | 41 | 665 | 2.5 | 49 | 409 | 27 | Comparative Example |
| 8 | B | 50 | 605 | 1.5 | 52 | 414 | 27 | Comparative Example |
| 9 | B | 13 | 680 | 1.1 | 58 | 426 | 25 | Comparative Example |
| 10 | B | 46 | 530 | 2.3 | 49 | 429 | 25 | Comparative Example |
| 11 | B | 30 | 723 | 2.2 | 56 | 412 | 25 | Comparative Example |
| 12 | B | 56 | 639 | 0.0 | 53 | 414 | 25 | Comparative Example |
| 13 | B | 48 | 632 | 3.4 | 43 | 423 | 25 | Comparative Example |
| 14 | B | 44 | 650 | 2.2 | 37 | 434 | 25 | Comparative Example |
| 15 | B | 49 | 628 | 2.3 | 58 | 352 | 25 | Comparative Example |
| 16 | B | 24 | 642 | 3.0 | 42 | 410 | 50 | Comparative Example |
| 17 | B | 65 | 680 | 2.5 | 47 | 415 | 10 | Comparative Example |
| 18 | C | 48 | 629 | 2.6 | 51 | 390 | 15 | Example of the present invention |
| 19 | D | 47 | 644 | 2.7 | 43 | 470 | 15 | Example of the present invention |
| 20 | E | 54 | 610 | 2.4 | 55 | 411 | 20 | Example of the present invention |

TABLE 4-continued

| Production No. | Steel No. | Average cooling rate of primary cooling ° C./s | Primary cooling stop temperature ° C. | Air cooling time in a temperature range of 600 to 700° C. s | Average cooling rate of secondary cooling ° C./s | Coiling temperature ° C. | Average cooling rate of tertiary cooling ° C./h | Note |
|---|---|---|---|---|---|---|---|---|
| 21 | F | 39 | 675 | 2.5 | 56 | 448 | 20 | Example of the present invention |
| 22 | G | 45 | 658 | 2.9 | 58 | 442 | 20 | Example of the present invention |
| 23 | H | 42 | 678 | 1.7 | 52 | 447 | 20 | Example of the present invention |
| 24 | I | 39 | 692 | 2.2 | 41 | 438 | 15 | Example of the present invention |
| 25 | J | 45 | 652 | 2.3 | 51 | 433 | 25 | Example of the present invention |
| 26 | K | 26 | 632 | 2.0 | 40 | 440 | 25 | Example of the present invention |
| 27 | L | 41 | 688 | 2.6 | 44 | 428 | 25 | Example of the present invention |
| 28 | M | 52 | 608 | 1.2 | 43 | 428 | 25 | Example of the present invention |
| 29 | N | 51 | 616 | 2.3 | 43 | 438 | 25 | Example of the present invention |
| 30 | O | 42 | 657 | 1.5 | 53 | 471 | 27 | Comparative Example |
| 31 | P | 48 | 653 | 2.8 | 58 | 328 | 27 | Comparative Example |
| 32 | Q | 44 | 651 | 2.1 | 56 | 460 | 27 | Comparative Example |
| 33 | R | 51 | 614 | 3.0 | 44 | 470 | 25 | Comparative Example |
| 34 | S | 44 | 649 | 1.0 | 54 | 374 | 20 | Comparative Example |
| 35 | T | 33 | 692 | 2.4 | 54 | 415 | 20 | Comparative Example |
| 36 | U | 41 | 666 | 1.7 | 46 | 393 | 20 | Comparative Example |
| 37 | V | 15 | 686 | 7.0 | 38 | 370 | 60 | Comparative Example |
| 38 | W | 42 | 684 | 2.8 | 52 | 448 | 25 | Example of the present invention |
| 39 | X | 100 | 605 | 3.0 | 67 | 430 | 35 | Example of the present invention |
| 40 | B | 68 | 620 | 7.1 | 65 | 406 | 25 | Comparative Example |

The underline indicates that conditions are not preferable

TABLE 5

| Production No. | Steel No. | Ferrite area % | Bainite area % | Retained austenite area % | Fresh martensite area % | Pearlite area % | Average particle size of ferrite μm | Difference in average hardness between ferrite and bainite MPa | Sheet thickness mm | Note |
|---|---|---|---|---|---|---|---|---|---|---|
| 1 | A | 25 | 64 | 9 | 2 | 0 | 1.40 | 846 | 3.6 | Example of the present invention |
| 2 | B | 12 | 68 | 20 | 0 | 0 | 1.52 | 967 | 2.1 | Example of the present invention |
| 3 | B | 11 | 73 | 16 | 0 | 0 | 1.43 | 1240 | 2.6 | Comparative Example |

TABLE 5-continued

| Production No. | Steel No. | Ferrite area % | Bainite area % | Retained austenite area % | Fresh martensite area % | Pearlite area % | Average particle size of ferrite μm | Difference in average hardness between ferrite and bainite MPa | Sheet thickness mm | Note |
|---|---|---|---|---|---|---|---|---|---|---|
| 4 | B | 11 | 74 | 15 | 0 | 0 | 1.40 | 1146 | 2.9 | Comparative Example |
| 5 | B | 9 | 75 | 15 | 1 | 0 | 2.42 | 925 | 2.6 | Comparative Example |
| 6 | B | 9 | 74 | 15 | 2 | 0 | 4.10 | 924 | 2.6 | Comparative Example |
| 7 | B | 7 | 77 | 13 | 0 | 3 | 4.80 | 18 | 2.9 | Comparative Example |
| 8 | B | 12 | 76 | 12 | 0 | 0 | 5.20 | 879 | 2.6 | Comparative Example |
| 9 | B | 32 | 51 | 12 | 5 | 0 | 5.43 | 1125 | 2.6 | Comparative Example |
| 10 | B | 28 | 58 | 10 | 0 | 4 | 2.84 | 1071 | 2.9 | Comparative Example |
| 11 | B | 25 | 63 | 12 | 0 | 0 | 1.85 | 1035 | 2.6 | Comparative Example |
| 12 | B | 0 | 84 | 12 | 4 | 0 | — | — | 2.9 | Comparative Example |
| 13 | B | 35 | 52 | 10 | 0 | 3 | 2.85 | 976 | 2.9 | Comparative Example |
| 14 | B | 12 | 79 | 4 | 0 | 5 | 2.10 | 984 | 2.6 | Comparative Example |
| 15 | B | 12 | 38 | 10 | 0 | 0 | 1.85 | 974 | 2.1 | Comparative Example |
| 16 | B | 28 | 57 | 4 | 11 | 0 | 3.24 | 954 | 2.1 | Comparative Example |
| 17 | B | 22 | 76 | 2 | 0 | 0 | 2.12 | 846 | 2.1 | Comparative Example |
| 18 | C | 10 | 67 | 23 | 0 | 0 | 1.62 | 913 | 2.1 | Example of the present invention |
| 19 | D | 18 | 76 | 6 | 0 | 0 | 2.14 | 972 | 4.2 | Example of the present invention |
| 20 | E | 28 | 61 | 8 | 0 | 3 | 3.47 | 924 | 2.6 | Example of the present invention |
| 21 | F | 29 | 56 | 15 | 0 | 0 | 3.20 | 897 | 1.8 | Example of the present invention |
| 22 | G | 12 | 71 | 12 | 5 | 0 | 1.87 | 976 | 2.1 | Example of the present invention |
| 23 | H | 28 | 56 | 16 | 0 | 0 | 1.24 | 865 | 2.1 | Example of the present invention |
| 24 | 1 | 17 | 70 | 13 | 0 | 0 | 1.65 | 954 | 2.9 | Example of the present invention |
| 25 | J | 12 | 69 | 14 | 5 | 0 | 1.23 | 992 | 2.3 | Example of the present invention |
| 26 | K | 15 | 75 | 10 | 0 | 0 | 3.10 | 894 | 2.9 | Example of the present invention |
| 27 | L | 10 | 73 | 13 | 4 | 0 | 1.46 | 886 | 2.9 | Example of the present invention |
| 28 | M | 12 | 75 | 13 | 0 | 0 | 1.79 | 987 | 2.9 | Example of the present invention |
| 29 | N | 10 | 78 | 12 | 0 | 0 | 1.23 | 894 | 4.0 | Example of the present invention |
| 30 | O | 42 | 58 | 0 | 0 | 0 | 4.30 | 891 | 2.9 | Comparative Example |
| 31 | P | 0 | 49 | 8 | 43 | 0 | — | — | 2.9 | Comparative Example |
| 32 | Q | 10 | 87 | 3 | 0 | 0 | 1.62 | 874 | 4.0 | Comparative Example |
| 33 | R | 48 | 47 | 5 | 0 | 0 | 4.82 | 924 | 2.9 | Comparative Example |
| 34 | S | 0 | 72 | 4 | 24 | 0 | — | — | 2.3 | Comparative Example |

TABLE 5-continued

| Production No. | Steel No. | Ferrite area % | Bainite area % | Retained austenite area % | Fresh martensite area % | Pearlite area % | Average particle size of ferrite μm | Difference in average hardness between ferrite and bainite MPa | Sheet thickness mm | Note |
|---|---|---|---|---|---|---|---|---|---|---|
| 35 | T | 23 | 65 | 12 | 0 | 0 | 4.95 | 1232 | 2.9 | Comparative Example |
| 36 | U | 10 | 77 | 13 | 0 | 0 | 1.26 | 1165 | 2.6 | Comparative Example |
| 37 | V | 43 | 52 | 4 | 1 | 0 | 1.80 | 1242 | 2.1 | Comparative Example |
| 38 | W | 15 | 71 | 14 | 0 | 0 | 1.54 | 764 | 2.6 | Example of the present invention |
| 39 | X | 11 | 69 | 16 | 4 | 0 | 2.36 | 824 | 2.6 | Example of the present invention |
| 40 | B | 37 | 46 | 15 | 0 | 2 | 1.56 | 1152 | 2.9 | Comparative Example |

The underline indicates that it is outside the scope of the present invention or property values are not preferable

TABLE 6

| Production No. | Steel No. | Tensile strength TS MPa | Total elongation El % | Uniform elongation uEl % | TS × uEl MPa · % | Hole expansion rate λ % | Maximum bending angle α ° | Note |
|---|---|---|---|---|---|---|---|---|
| 1 | A | 1044 | 27.0 | 10.0 | 10440 | 48 | 62 | Example of the present invention |
| 2 | B | 1216 | 20.0 | 12.0 | 14592 | 56 | 75 | Example of the present invention |
| 3 | B | 1086 | 13.6 | 8.1 | 8797 | 24 | 48 | Comparative Example |
| 4 | B | 1179 | 14.8 | 8.1 | 9550 | 32 | 48 | Comparative Example |
| 5 | B | 1254 | 15.0 | 6.6 | 8276 | 42 | 52 | Comparative Example |
| 6 | B | 1178 | 17.0 | 7.0 | 8246 | 43 | 61 | Comparative Example |
| 7 | B | 1211 | 16.2 | 6.8 | 8235 | 32 | 61 | Comparative Example |
| 8 | B | 1054 | 22.0 | 9.8 | 10329 | 35 | 51 | Comparative Example |
| 9 | B | 976 | 21.0 | 11.0 | 10736 | 35 | 57 | Comparative Example |
| 10 | B | 987 | 18.4 | 10.0 | 9870 | 38 | 56 | Comparative Example |
| 11 | B | 992 | 20.1 | 10.0 | 9920 | 35 | 52 | Comparative Example |
| 12 | B | 1201 | 15.0 | 6.8 | 8167 | 58 | 58 | Comparative Example |
| 13 | B | 972 | 23.0 | 15.0 | 14580 | 44 | 58 | Comparative Example |
| 14 | B | 1257 | 12.4 | 6.5 | 8171 | 52 | 61 | Comparative Example |
| 15 | B | 1262 | 12.1 | 5.9 | 7446 | 48 | 64 | Comparative Example |
| 16 | B | 1351 | 12.0 | 6.0 | 8106 | 38 | 47 | Comparative Example |
| 17 | B | 992 | 17.0 | 8.0 | 7936 | 57 | 61 | Comparative Example |
| 18 | C | 1287 | 21.0 | 10.1 | 12999 | 50 | 65 | Example of the present invention |
| 19 | D | 984 | 21.0 | 11.0 | 10824 | 48 | 74 | Example of the present invention |
| 20 | E | 1221 | 13.4 | 11.3 | 13797 | 52 | 75 | Example of the present invention |
| 21 | F | 1236 | 15.6 | 12.0 | 14832 | 49 | 72 | Example of the present invention |

TABLE 6-continued

| Production No. | Steel No. | Tensile strength TS MPa | Total elongation El % | Uniform elongation uEl % | TS × uEl MPa · % | Hole expansion rate λ % | Maximum bending angle α ° | Note |
|---|---|---|---|---|---|---|---|---|
| 22 | G | 1182 | 14.2 | 12.0 | 14184 | 56 | 76 | Example of the present invention |
| 23 | H | 1213 | 17.0 | 9.2 | 11160 | 55 | 76 | Example of the present invention |
| 24 | I | 1257 | 16.0 | 7.1 | 8925 | 47 | 67 | Example of the present invention |
| 25 | J | 1294 | 16.2 | 7.2 | 9317 | 47 | 64 | Example of the present invention |
| 26 | K | 1192 | 19.0 | 9.1 | 10847 | 54 | 69 | Example of the present invention |
| 27 | L | 1242 | 17.4 | 8.6 | 10681 | 46 | 62 | Example of the present invention |
| 28 | M | 1275 | 14.2 | 6.8 | 8670 | 48 | 60 | Example of the present invention |
| 29 | N | 1274 | 15.4 | 6.8 | 8663 | 49 | 64 | Example of the present invention |
| 30 | O | 804 | 26.2 | 15.0 | 12060 | 25 | 79 | Comparative Example |
| 31 | P | 1542 | 9.0 | 6.0 | 9252 | 15 | 41 | Comparative Example |
| 32 | Q | 976 | 15.0 | 7.0 | 6832 | 68 | 69 | Comparative Example |
| 33 | R | 792 | 23.0 | 12.0 | 9504 | 62 | 72 | Comparative Example |
| 34 | S | 1524 | 11.0 | 5.0 | 7620 | 25 | 43 | Comparative Example |
| 35 | T | 1023 | 23.0 | 11.0 | 11253 | 36 | 51 | Comparative Example |
| 36 | U | 1232 | 16.0 | 8.1 | 9979 | 42 | 51 | Comparative Example |
| 37 | V | 832 | 29.0 | 18.0 | 14976 | 32 | 48 | Comparative Example |
| 38 | W | 1175 | 16.0 | 9.2 | 10810 | 54 | 64 | Example of the present invention |
| 39 | X | 1215 | 14.2 | 7.2 | 8748 | 52 | 63 | Example of the present invention |
| 40 | B | 956 | 22.4 | 15.0 | 14340 | 38 | 56 | Comparative Example |

The underline indicates that it is outside the scope of the present invention or property values are not preferable As can be understood from Table 6, in examples of the present invention, hot-rolled steel sheets having excellent strength, ductility, hole expansibility and bendability were obtained.

On the other hand, in comparative examples in which the chemical composition and/or the microstructure were not within the ranges defined by the present invention, any one or more of the above properties were poor. Here, in Production No. 15, since an amount of bainite was insufficient and tempered martensite was generated, the ductility deteriorated. In addition, in Production No. 16, the amount of fresh martensite was large, the difference in hardness between overall structures was large, and thus the hole expansibility and bendability deteriorated.

INDUSTRIAL APPLICABILITY

According to the above aspect of the present invention, it is possible to provide a hot-rolled steel sheet having excellent strength, ductility, hole expansibility and bendability.

The invention claimed is:

1. A hot-rolled steel sheet having a chemical composition containing, in mass %, C: 0.100 to 0.350%,
Si: 0.01 to 3.00%,
Mn: 1.00 to 4.00%,
sol. Al: 0.001 to 2.000%,
Si+sol. Al: 1.00% or more,
Ti: 0.010 to 0.380%,
P: 0.100% or less,
S: 0.0300% or less,
N: 0.1000% or less,
O: 0.0100% or less,
Nb: 0 to 0.100%,
V: 0 to 0.500%,
Cu: 0 to 2.00%,
Cr: 0 to 2.00%,
Mo: 0 to 1.00%,
Ni: 0 to 2.00%,
B: 0 to 0.0100%,
Ca: 0 to 0.0200%,
Mg: 0 to 0.0200%,
REM: 0 to 0.1000%,
Bi: 0 to 0.020%,
one or more of Zr, Co, Zn and W: 0 to 1.00% in total, and
Sn: 0 to 0.050%,
in which Tief represented by the following Formula (a) is 0.010 to 0.300%, and
the remainder comprising Fe and impurities, and
a microstructure comprising, in area %,
ferrite: 10 to 30%,
bainite: 40 to 78%,
retained austenite: 12 to 30%,
fresh martensite: 5% or less, and
pearlite: 5% or less,
wherein the ferrite has an average particle size of 5.00 μm or less,
wherein a difference between an average nanoindentation hardness of the ferrite and an average nanoindentation hardness of the bainite is 1,000 MPa or less, and
wherein the tensile strength is 980 MPa or more:

$$Tief=Ti-48/14\times N-48/32\times S \quad (a)$$

where each element symbol in Formula (a) indicates their content (mass %).

2. The hot-rolled steel sheet according to claim 1,
wherein the chemical composition contains, in mass %, one or more of
Nb: 0.005 to 0.100%,
V: 0.005 to 0.500%,
Cu: 0.01 to 2.00%,
Cr: 0.01 to 2.00%,
Mo: 0.01 to 1.00%,
Ni: 0.02 to 2.00%,
B: 0.0001 to 0.0100%,
Ca: 0.0005 to 0.0200%,
Mg: 0.0005 to 0.0200%,
REM: 0.0005 to 0.1000%, and
Bi: 0.0005 to 0.020%.

* * * * *